United States Patent [19]

Wegner et al.

[11] Patent Number: 5,016,700

[45] Date of Patent: May 21, 1991

[54] INSULATED METAL PANEL GARAGE DOOR

[75] Inventors: David K. Wegner, Milford; Larry J. Schlicht, Oxford, both of Mich.

[73] Assignee: The Stanley Works, New Britain, Conn.

[21] Appl. No.: 548,074

[22] Filed: Jul. 5, 1990

[51] Int. Cl.[5] ..... E06B 3/12

[52] U.S. Cl. ..... 160/232; 160/201

[58] Field of Search ..... 160/201, 229.1, 232, 160/236, 40, 206, 207, 213, 199; 52/802, 809, 309.9, 309.14

[56] References Cited

U.S. PATENT DOCUMENTS

| | | | |
|---|---|---|---|
| 3,967,671 | 7/1976 | Stanley et al. | 160/201 X |
| 4,156,448 | 5/1979 | Bengtsson | 160/232 |
| 4,284,119 | 8/1981 | Martin et al. | 160/232 |
| 4,379,480 | 4/1983 | Kempel et al. | 160/201 X |
| 4,518,026 | 5/1985 | Otto et al. | 160/232 |
| 4,854,365 | 8/1989 | Juneau | 160/232 |
| 4,893,666 | 1/1990 | Hormann | 160/201 X |

*Primary Examiner*—David M. Purol

[57] ABSTRACT

A garage door has a multiplicity of transversely extending panels with a preformed core of synthetic resin and integrally formed metallic front and rear skins of the same configuration but reversed. The front skin has its top edge portion configured with an inwardly and then upwardly extending wall portion to define a shelf-like recess adjacent the front face, a generally horizontal top wall portion and a depending lip portion. The bottom edge portion of the outer skin is configured with a generally U-shaped portion extending downwardly from the core and configured and dimensioned to be received within the shelf-like recess of the next lower panel, a generally horizontal portion, and an upwardly extending lip portion. The core has its top edge formed with a shelf-like recess adjacent its front face and a channel-like recess spaced rearwardly therefrom, and the bottom edge has a shelf-like recess adjacent its rear face and a channel-like recess spaced forwardly therefrom. The depending lip portions on the upper edge portions of the skins extend into the channel-like recess in the top edges of the core and the upwardly extending lip portions on the bottom edge portions of the skins extending into the channel-like recess on the bottom edge of the core. Insulating spacer elements may be provided in the channel-like recesses between the lip portions, and hinges hingedly connect the panels.

19 Claims, 3 Drawing Sheets

32
16
48
60
36
23
68
34
26
28
34
24
56
58
52
54
50
30

INSULATED METAL PANEL GARAGE DOOR

BACKGROUND OF THE INVENTION

The present invention relates to overhead doors comprised of vertically spaced panels and, more particularly, to such doors having plastic cores and metal skins with improved but simple insulating features.

The use of panels formed of a core of lightweight insulating material clad with relatively thin metal skins, joined together by hinges to make strong, lightweight roll-up doors is virtually the standard design in the garage door industry.

Early designs used expanded foam, injected between front and rear metal skins, as the rigid, insulating core. However, problems with voids in such cores, along with the need for clamping jigs and sealing during the foaming operation have favored the use of preformed cores to which the metal skins may be rapidly affixed by adhesives.

With proper choice of core material and bonding agents, such panels can be fabricated in a fraction of the time and at a fraction of the cost of foamed-in-place panels, with little if any decrease in stength or durability. The metal skins of such panels can be embossed with wood grain or other patterns, and with simulated raised or recessed portions, moldings or other architectural details to match or enhance any design. Moreover, they may be painted or resin coated. They are much lighter than predecessor wood panels, and so can be countersprung with smaller and less costly springs and operated with smaller, less expensive motors in the door operators. Garage doors constructed in this way will not warp or rot as do wooden doors. In addition, such doors may provide excellent insulating properties which are so desirable for energy conservation.

Despite these many advantages, there are various problems which are inadequately addressed by various existing designs. Among these problems is the need to hold the inner and outer skins together to provide a clamping force between the skins on the surfaces of the core section they face. Among the means currently employed for this purpose are metal skins with complexly formed top and bottom ends, whose return edges are complementarily shaped to interlock with each other, thus holding the core material in compression while any interposed adhesive cures.

Another approach to solving this problem has been to use metal skins in which similarly formed top and bottom edges face each other like mirror images across an intervening preformed core, with the adjacent portions of the edges being held together by clips to provide contact pressure between the core and the metal skins while any interposed adhesive cures. Generally, such clips are quite small so they are usually made of metal to achieve the needed strength in the small cross section. To prevent thermal conduction between the front and rear metal skins, such clips are commonly faced with a conforming flexible resinous or ribbing material which provides a thermal break. Whether made of metal or any other material, such clips typically bridge either or both the top and bottom edges of each panel, and their presence tends to interfere with the generally essential weather and thermal seals.

Panels which are assembled into hinged sectional doors may also have along their top and bottom edges some form of elastomeric element which seals the joint between the panels when the door is closed. The simplest type of such weatherseal, regardless of its shape or composition, is a continuous member extending along the entire length.

Another problem with existing panel designs is the difficulty of adequately anchoring the hinges and other needed hardware in the panels, since neither the relatively soft core material nor the thin metal skin is sufficiently strong. Typical prior art solutions to this problem involve the use of thicker metal sections at hinge attachment points and at other stress locations. An alternative uses inserts of metal or wood to serve as load-bearing points. Both approaches tend to add cost and manufacturing time.

It is an object of the present invention to provide a novel garage door using metal clad door panels in which preformed core sections and stiles are readily assembled with metal skins of relatively simple configuration.

It is also an object to provide such doors in which the panels are strong, lightweight and relatively inexpensive.

A further object is to provide such doors which obviate the need for special inserts or structures as hardware attachment points.

SUMMARY OF THE INVENTION

It has now been found that the foregoing and related objects may be readily attained in a garage door, which has a multiplicity of transversely extending panels each comprising a preformed core of synthetic resin with front and rear faces and upper and lower edges, and integrally formed metallic front and rear skins. Both skins have a vertically extending face portion and top and bottom edge portions, and the front and rear skins of each panel are of the same configuration but the inner skin is rotated 180° about horizontal axis of the door so that it is reversed.

The front skin has its face portion extending along the front face of the core, and its top edge portion has a configuration extending rearwardly from the face portion which comprises an inwardly and then upwardly extending wall portion defining a shelf-like recess adjacent the front face, a generally horizontal top wall portion, and a depending lip portion. The bottom edge portion of the outer skin has a configuration extending rearwardly from the face portion which comprises a generally U-shaped portion extending downwardly from the core and configured and dimensioned to be received within the shelf-like recess of the next lower panel, a generally horizontal portion, and an upwardly extending lip portion.

The rear skin has its face portion bearing against the rear face of the core and has its top and bottom edges reversed from the orientation of the front skin to provide an upstanding inverted U-shaped lip portion along its upper edge portion and a shelf-like portion on its lower edge portion. The skins of each panel have their upper and lower edge portions spaced apart.

The core has its top edge formed with a shelf-like recess adjacent its front face and with a channel-like recess spaced rearwardly therefrom. The bottom edge has a shelf-like recess adjacent its rear face, and a channel-like recess spaced forwardly therefrom. The depending lip portions on the upper edge portions of the skins extend into the channel-like recess in the top edge of the core and the upwardly extending lip portions on the bottom edge portions of the skins extend into the channel-like recess on the bottom edge of the core.

The panels also include insulating spacer elements in the channel-like recesses between the lip portions, and the door also has hinge means hingedly connecting the adjacent panels.

Desirably, the insulating spacer elements project beyond the plane of the horizontal portion of the edge portions of the skins towards the edge portions of the skins of the adjacent panels to provide sealing action in the closed position of the door, and the insulating elements are of deformable material.

Preferably, the lip portion on the skins are of generally J-shaped or hook-shaped configuration with the free ends slightly embedded in the core. The upstanding lip portion on the upper edge of the rear skin extends into the space provided by the shelf portion of the rear skin of the panel thereabove.

In the preferred embodiments, the panels have wooden stiles disposed between the skins and extending vertically along the sides thereof, and the top and bottom edges of the stiles are configured similarly to the core. In addition, the panels include at least one vertically extending wooden reinforcing element spaced the length thereof. The hinge means are hinges secured to the panels at the stiles and reinforcing elements. The core is a closed cellular foamed synthetic resin, and the skins are adhesively bonded to the core.

DETAILED DESCRIPTION OF PREFERRED EMBODIMENT OF THE INVENTION

Figure 1:
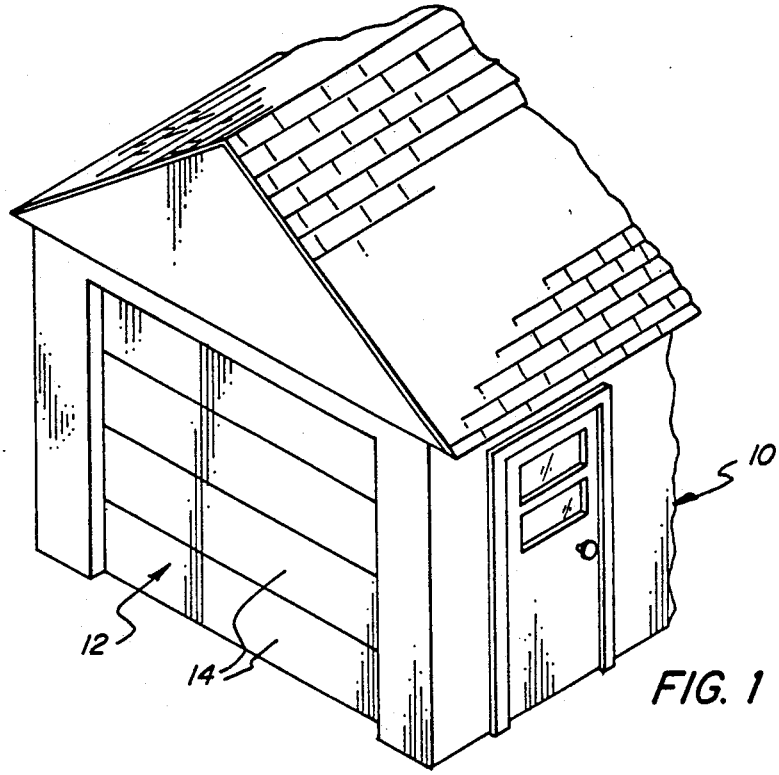
FIG. 1 is a fragmentary view of a garage with a roll-up sectional door embodying the present invention.

Turning first to FIG. 1, therein illustrated a garage or similar structure 10 which is provided with a large sectional door generally designated by the numeral 12 and comprised of a multiplicity of substantially similar panels 14 vertically arranged one above the other. The door 12 is of the roll-up type in which each panel is connected to its neighboring panel by hinges and moves from the illustrated vertical position closing the opening to a substantially horizontal position at or above the top of the door opening. As is well known, such doors require a variety of hardware for the installation including tracks, counterbalancing springs and hinges. These are not shown since they would be on the rear surface of door 12 and within the garage 10. FIG. 1 also does not show the flexible weatherstrip sweep at the bottom edge of the door 12 which serves to seal out dust and weather.

Figure 2:
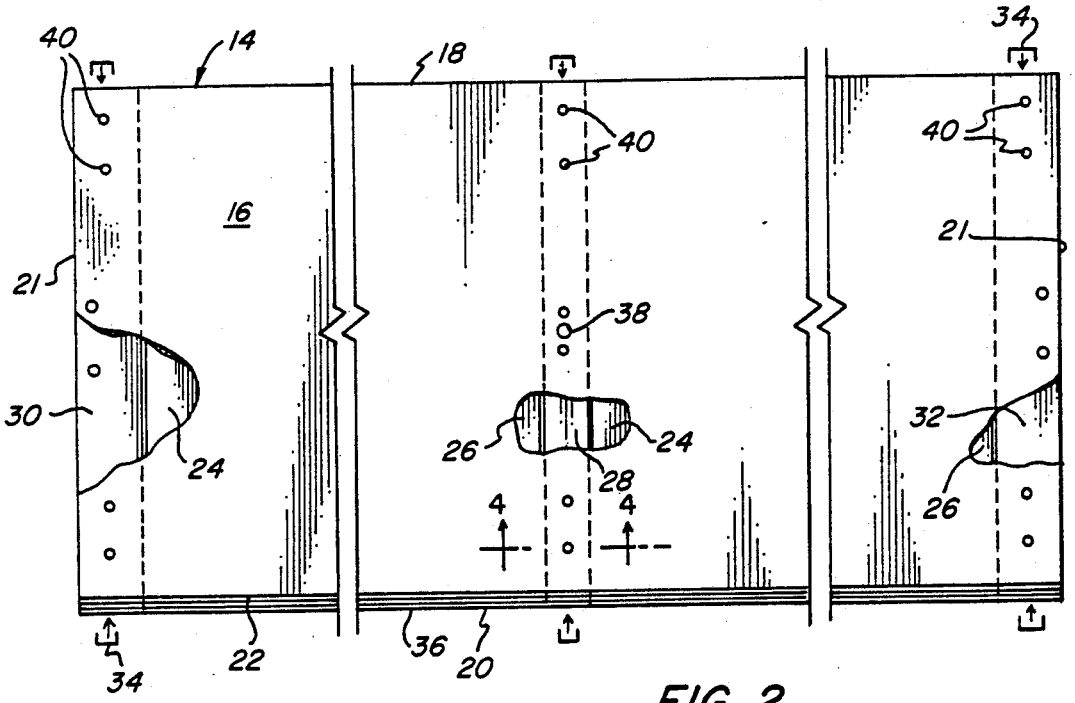
FIG. 2 is a fragmentary front view of a single panel of the door, partially cutaway to show the location of the stiles and center reinforcing member, and showing punched apertures where hardware may be attached.

Turning now to FIG. 2, therein shown is a partially cutaway view of a single panel 14, showing the rear metal skin 16 with its bottom and top edges 18 and 20 respectively, and side edges 21. Also seen are the bottom lip 22 of the front metal skin, the preformed core sections 24 and 26, the center reinforcing member 28, and the stiles 30 and 32. Also shown are the staples 34 that may be used to aid assembly of the skins to the member 28 and stiles 30, 32 during panel fabrication, and the bottom insulating strip 36, and the aperture 38 through which the combination latching handle/lock (not shown) extends from the front face.

Figure 4:
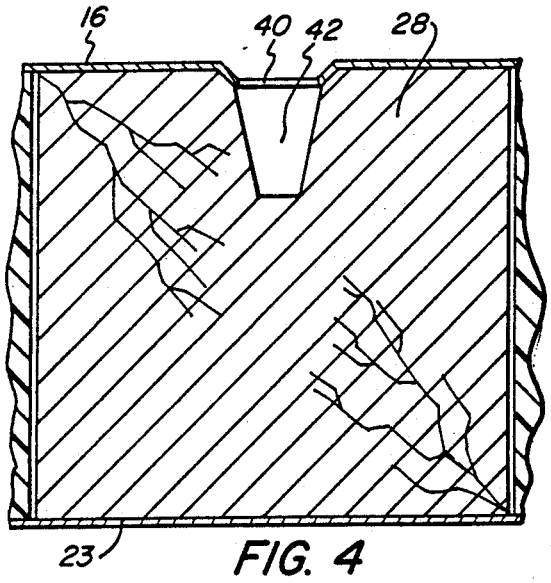
FIG. 4 is a fragmentary cross sectional view of the panel along the line 4—4 of FIG. 2 to show a typical hardware attachment point.

Lastly, punched holes 40 are provided in the metal skin 16 for attachment of hardware (hinges, etc.) to the wooden stiles 30, 32 and member 28. In FIG. 4, a fragmentary cross section of the panel 14 is provided to show the punched hole 40 for receiving fasteners and the like, and the center reinforcing member 28 is provided with a starting recess 42 to accept a screw or other fastener (not shown). It should be noted that the outer skin 23 is devoid of such punched apertures; except for hole 38 which serves to admit a latching handle/lock presents an unbroken weatherproof face to the elements.

Figure 3:
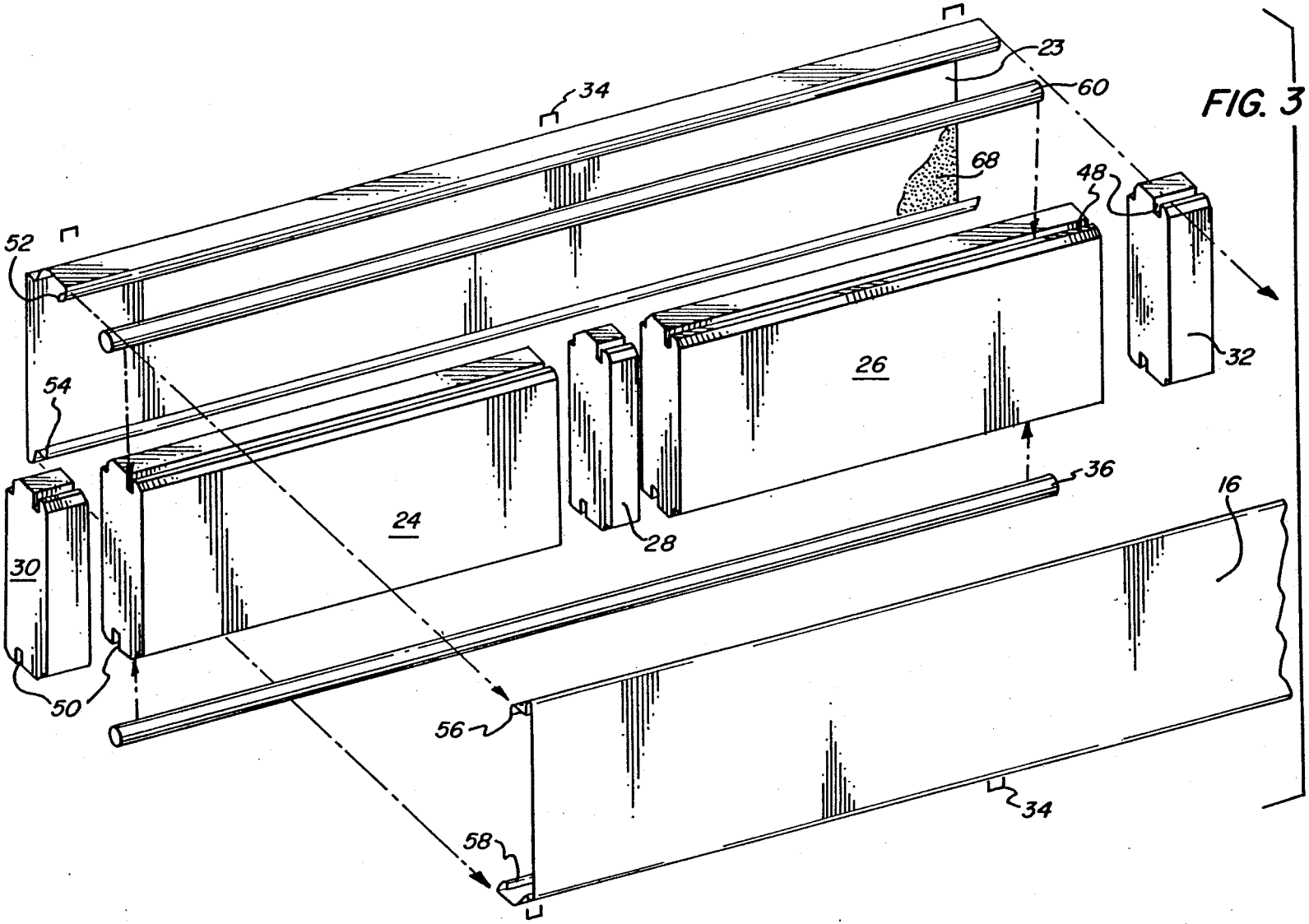
FIG. 3 is an exploded view of the panel of FIGS. 2.

In FIG. 3, the several components of top panel 14 are illustrated in an exploded condition. It should be noted that the rear and front metal skins 16, 23 are of substantially the same configuration, except for the attachment apertures 40 previously discussed and not shown here. However, they are rotated 180° about the horizontal axis of the panel to face oppositely and be upside down relative to one another. Thus, the bottom edge 44 of front skin 23 is of the same configuration as the top edge 20 of rear skin 16, while the top edge 46 of 23 is shaped like the bottom edge 18 of the rear skin 16. These edge configurations will be described hereinafter.

The stiles 30, 32, center member 28, and preformed core sections 24, 26 are of the same edge configuration and have top and bottom channels or grooves 48 and 50 respectively, into which the lips 52 and 54, and 56 and 58 of the front and rear skins 23, 16 respectively are engaged upon assembly. Those grooves 48, 50 also seat the top and bottom elastomeric insulating elements 60 and 36, respectively. Area 68 designates the adhesive coating on a small portion of the inner surface of the front skin 23. The entire inner surface of both metal skins is typically coated with an adhesive prior to assembly of the panel components.

Figure 5:
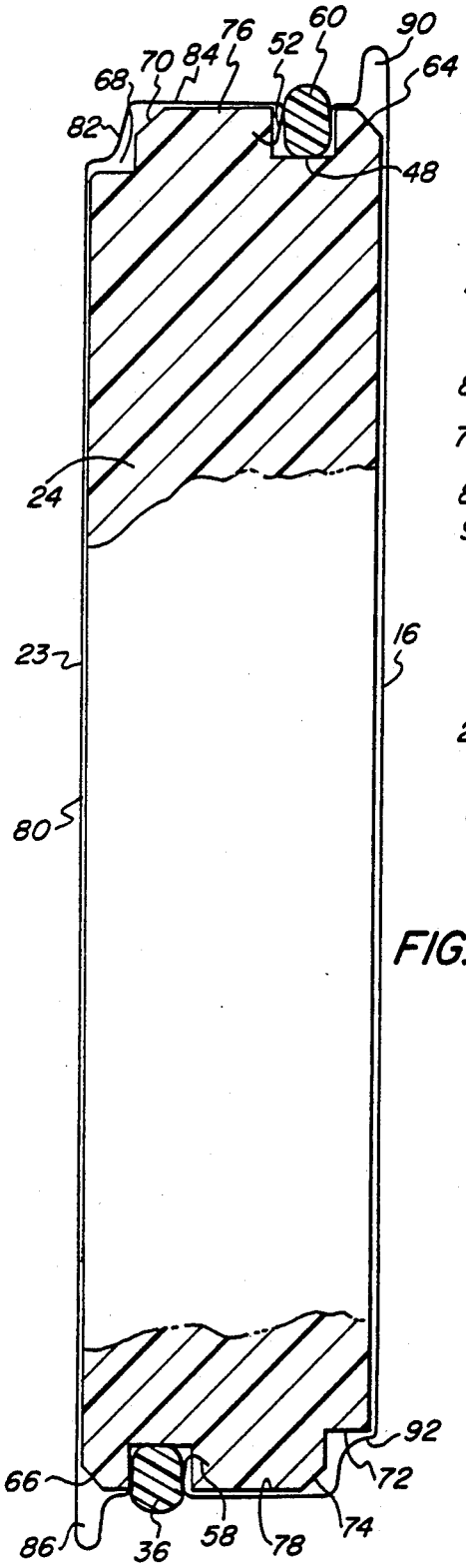
FIG. 5 is a cross sectional view of the panel showing the reversed metal skins, the preformed core, and the spacer and insulating element.
Figure 6:
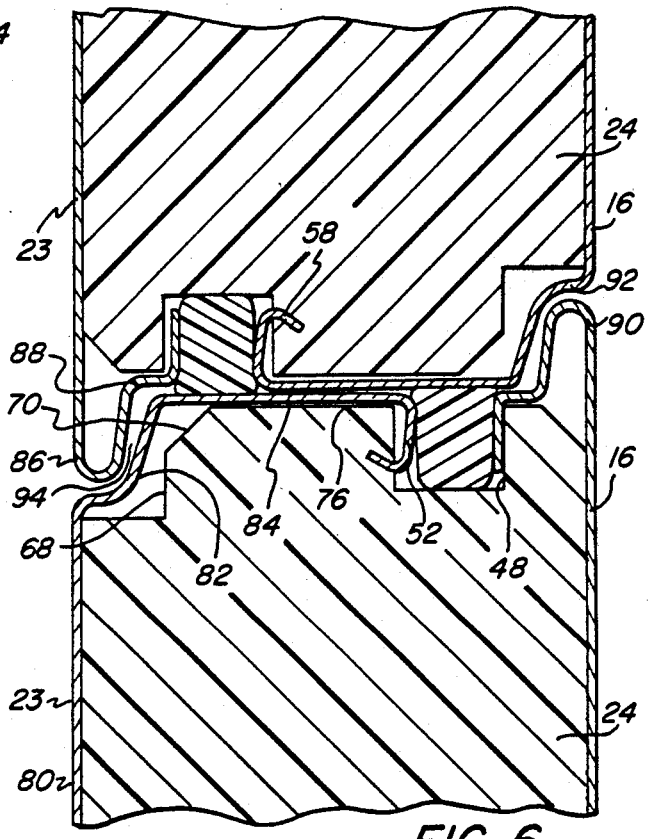
FIG. 6 is a fragmentary cross sectional view of the juncture between two panels, the bottom of one panel being disposed adjacent the top edge of the other, and compressing their respective insulating elements.

The configuration of the edges of the core sections 24, 16 and of the center member 28 and stiles 30, 32 can best be seen in FIGS. 5 and 6. The top and bottom edge configurations are essentially mirror images with the groove or channel 48 being spaced more closely to the rear skin 16 and the groove or channel 50 being spaced more closely to the front skin 23. The adjacent edges are chamferred as illustrated at 64, 66. The top edge has a shelf-like recess 68 with a chamfer 70 adjacent the front skin 23 and the bottom edge has a simular recess 72 and chamfer 74 adjacent the rear skin 16. Between the chamfers 70, 74 and channels 48, 50 are horizontal surfaces 76, 78.

The front skin 23 has a generally planar face portion 80 and its top edge portion is configured with an inwardly then upwardly extending portion 82 providing a shelf-like recess adjacent the front face portion 80, and it overlies the shelf-like recess 68. It then has a horizontal portion 84 which overlies the horizontal portion 76, and a depending straight lip 52 which extends into the channel 48. The bottom edge portion is configured with a depending U-shaped portion 86, a short horizontal portion 88, and an upstanding lip 54 of a straight configuration which extends into the channel 50.

As previously indicated, the rear skin 16 is identically configured but reversed. Thus, it has at its upper end, an inverted U-shaped projection 90, and a depending hook-shaped lip 56, and, at its lower end, a shelf portion 92 and an upstanding hook shaped lip 58. These lips 56, 58 also extend into the channels 48, 50 and are embedded in the core section 24 in spaced relationship to the front skin 23.

In FIGS. 5 and 6, it can be seen that the insulating elements 36 and 60 are deformed from the cylindrical configuration seen in FIG. 3 when they are pressed into the channels 48 and 50 between the opposed lips of the front and rear skins 23, 16. They project beyond the planes of the horizontal portions of the skins 23, 16 and will normally abut the horizontal portions of the skins of the adjacent panels as seen in FIG. 6.

In assembling the components, the adhesively coated front skin 23 is placed on the work surface. The stiles 30, 32 are positioned on the skin so that straight lip 54 engages groove 50 and the stiles are flush with the end of the skin. Downward pressure is then applied to the stiles 30, 32 which outwardly deforms the flange 84 until the J-shaped lip 52 snaps into groove 48. The stiles are further pressed against the adhesive coating. Next the core material sections adjacent the ends 24 and 26 are slid onto the straight flange 54; flange 84 similarly deforms until lip 52 engages the groove 48. The long surface area of the relatively soft core sections provides adequate force to temporarily deform the flange 84. The springy retaining force of the lip 54 in the groove 48 provides some pressure to hold the adhesive coated inner surface of the metal skin in contact with core section 24 and 26, thus providing some rigidity to the partially assembled panel. The rear skin 16 is assembled by sliding straight flange 56 into the groove 48 and snapping lip 58 into groove 50. The two skins 16, 23 may be secured to the stiles 30, 32 intermediate reinforcing member (if any) and center member 28 by staples 34. As with the rear skin, the springiness of the front skin 23 effects contact between the adhesively coated skin and the stiles and core sections until the adhesive cures, at which time the panel reaches its full strength and rigidity. Springiness of the top and bottom sections of the metal skins is assured both by the choice of metal and by the fact that the edge portions of those sections are generally formed to lie at approximately 87° from the vertical. When they are snapped onto the stiles and core sections, they are forced open to 90°, providing the needed springy contact force. However, the preferred manufacturing process augments this contact force by placing the assembled panels in a press for a period of time sufficient for the adhesive bond to develop.

The chamfers 64, 66, 70 and 74 serve dual purposes. They remove what would otherwise be, in typical core materials like expanded polystyrene, easily damaged edges. They also serve as ramps along which the lips of the metal skins can bear as the stiles and core sections are slid relative to those lips until the latter seat themselves in the grooves or channels.

During assembly, the stiles and core sections are preferably inserted downwardly into the front metal skin tilted at the angle of the chamfer so that chamfer surface is in substantially full contact with the inner surface of 23. Then, when the left hand edge of the groove has bottomed behind the lip, the stile or core section being inserted is swung counter-clockwise, so that the chamfer contacts the lip, which slides up onto the horizontal portion of the stile or core section, and it then slides along that flat portion until it snaps into the groove. The rear skin can then be applied by sliding it down into its groove, and, when it seats, sliding the bottom lip of the panel 16 onto chamfer and thence along the flat bottom of the stile or core section until the lip snaps into its groove. The insulating elements are seated in their respective grooves and are desirably held there by the compressive force of the insulating elements.

As seen in FIG. 6, the elastomeric insulating elements compress when the panels are vertically disposed to block wind, dirt and moisture from passing between the panels. Moreover, these elements have sufficient height to keep the outer skin of each lower panel from contacting the inner skin of the adjacent upper panel, thus preventing the establishment of a path for thermal conduction between them.

At the juncture between the front skins, there is a downwardly extending open channel 94 partially closed by the depending U-shaped portion 86 and sealed at its end by the insulating element 60. This is designed to drain any water to the outside of the door, thus preventing the formation of damaging ice.

Numerous alternative design possibilities will be obvious to anyone familiar with the art. For example, instead of punching the metal skins where hardware is to be attached by fasteners, it may suffice to mark those attachment points with paint or with adhesive dots. Furthermore, the metal skins need not have flat faces, but can be embossed with a textured or wood grain pattern, embossed with raised and/or recessed panel or with molding-like patterns, while retaining adequate surface for bonding to the stiles and core sections which will follow the contours of the skins.

Garage doors for residential use will vary in total thickness depending upon a variety of factors. Applicant's assignee generally uses panels providing a total thickness of $1\frac{3}{8}$ inch with skins of 0.016 inch thickness. With single width doors, a pair of stiles and a single reinforcing center member at the center will suffice to rigidify the panels and provide for mounting of the hardware. Three intermediate members are desirable in double doors of 15–18 feet width.

The preformed foam sheet material is cut to provide the desired contours. Polystyrene and polyurethane are conveniently employed. The channels or grooves in the core and stiles may have a width of 5/32 inch and a depth of 7/32 inch. The insulating members will have a diameter of $\frac{1}{4}$ inch for such grooves.

In this construction, the skins are spaced apart to provide a thermal barrier and the spacing between panels is effectively sealed.

Thus, the present invention provides a garage door using metal clad insulated door panels which are strong, lightweight and relatively inexpensive. They are readily assembled and, use a single skin configuration to provide effective thermal isolation between the external and internal surfaces of the doors.

Having thus described the invention, what is claimed is:

1. In a garage door, the combination comprising:

(A) a multiplicity of transversely extending panels each comprising (i) a preformed core of synthetic resin having front and rear faces and upper and lower edges; and (ii) integrally formed metallic front and rear skins having a vertically extending face portion and top and bottom edge portions, said front and rear skins of each panel being of the same configuration but with one skin rotated 180° about the horizontal axis of the door relative to the other skin so that it is reversed and said skins face oppositely from said core, the front skin having its face portion extending along the front face of said core and the top edge portion having a configuration extending rearwardly from said face portion and comprising, seriatim, (a) an inwardly and then upwardly extending wall portion defining a shelf-like recess adjacent the front face, (b) a generally horizontal top wall portion and (c) a depending lip portion, the bottom edge portion of said outer skin having a configuration extending rearwardly from said face portion comprising, seriatim, (a) a generally U-shaped portion extending downwardly from said core and configured and dimensioned to be received within said shelf-like recess of the next lower panel, (b) a generally horizontal portion, and (c) an upwardly extending lip portion, the rear skin having its face portion bearing against the rear face of said core and having the top and bottom edges reversed from the orientation of said front skin to provide an upstanding inverted U-shaped lip portion along its upper edge portion and a shelf-like portion on its lower edge portion, the upper and lower edge portions of said skins being spaced apart, said core having its top edge formed with a shelf-like recess adjacent its front face and having a channel-like recess spaced rearwardly therefrom, the bottom edge having a shelf-like recess adjacent its rear face, and a channel-like recess spaced forwardly therefrom, said depending lip portions on the upper edge portions of said skins extending into said channel-like recess in said top edges of said core and the upwardly extending lip portions on the bottom edge portions of said skins extending into said channel-like recess on the bottom edge of said core, (B) hinge means hingedly connecting said panels.

2. The garage door in accordance with claim 1 wherein each of said panels includes insulating spacer elements in said channel-like recesses between said lip portions.

3. The garage door in accordance with claim 2 wherein said insulating spacer elements project beyond the plane of the horizontal portion of said edge portions of said skins towards the edge portions of the skins of the adjacent panels to provide sealing action in the closed position of the door.

4. The garage door in accordance with claim 2 wherein said insulating elements are of deformable material.

5. The garage door in accordance with claim 1 wherein said depending lip portion on said front skin is of generally J-shaped configuration with its lower edge partially embedded in said core, and the lip portion on the rear skin is similarly embedded.

6. The garage door in accordance with claim 1 wherein the upstanding lip portion on the upper edge of said rear skin extends into the shelf portion of the rear skin of the panel thereabove.

7. The garage door in accordance with claim 1 wherein said panels have wooden stiles disposed between said skins and extending vertically along the sides thereof, said stiles having top and bottom edges configured similarly to said core.

8. The garage door in accordance with claim 7 wherein said panels include at least one vertically extending wooden reinforcing element spaced the length thereof.

9. The garage door in accordance with claim 8 wherein said hinge means are hinges secured to said panels at said stiles and reinforcing elements.

10. The garage door in accordance with claim 1 wherein said core is a closed cellular foamed synthetic resin.

11. The garage door in accordance with claim 9 wherein said skins are adhesively bonded to said core.

12. In a garage door, the combination comprising:

(A) a multiplicity of transversely extending panels each comprising (i) a preformed core of synthetic resin having front and rear faces and upper and lower edges;

(ii) integrally formed metallic front and rear skins having a vertically extending face portion and top and bottom edge portions, said front and rear skins of each panel being of the same configuration but with one skin rotated 180° about the horizontal axis of the door relative to the other skin so that it is reversed and said skins face oppositely from said core, the front skin having its face portion extending along the front face of said core and the top edge portion having a configuration extending rearwardly from said face portion and comprising, seriatim, (a) an inwardly and then upwardly extending wall portion defining a shelf-like recess adjacent the front face, (b) a generally horizontal top wall portion and (c) a depending lip portion, the bottom edge portion of said outer skin having a configuration extending rearwardly from said face portion comprising, seriatim, (a) a generally U-shaped portion extending downwardly from said core and configured and dimensioned to be received within said shelf-like recess of the next lower panel, (b) a generally horizontal portion, and (c) an upwardly extending lip portion, the rear skin having its face portion bearing against the rear face of said core and having the top and bottom edges reversed from the orientation of said front skin to provide an upstanding inverted U-shaped lip portion along its upper edge portion and a shelf-like portion on its lower edge portion, the upper and lower edge portions of said skins being spaced apart, said core having its top edge formed with a shelf-like recess adjacent its front face and having a channel-like recess spaced rearwardly therefrom, the bottom edge having a shelf-like recess adjacent its rear face, and a channel-like recess spaced forwardly therefrom, said depending lip portions on the upper edge portions of said skins extending into said channel-like recess in said top edges of said core and the upwardly extending lip portions on the bottom edge portions of said skins extending into said channel-like recess on the bottom edge of said core;

(iii) wooden stiles disposed between said skins and extending vertically along the sides thereof, said stiles having top and bottom edges configured similarly to said core; and (iv) insulating spacer elements in said channel-like recesses between said lip portions, said insulating spacer elements projecting beyond the plane of the horizontal portion of said edge portions of said skins towards the edge portions of the skins of the adjacent panels to provide sealing action in the closed position of the door; and (B) hinge means hingedly connecting said panels.

13. The garage door in accordance with claim 12 wherein said insulating elements are of deformable material.

14. The garage door in accordance with claim 12 wherein said depending lip portion on said front skin is of generally J-shaped configuration with its lower edge embedded in said core, and the lip portion on the rear skin is similarly embedded.

15. The garage door in accordance with claim 12 wherein the upstanding lip portion on the upper edge of said rear skin extends into the shelf portion of the rear skin of the panel thereabove.

16. The garage door in accordance with claim 12 wherein said panels include at least one vertically extending wooden reinforcing element spaced the length thereof.

17. The garage door in accordance with claim 16 wherein said hinge means are hinges secured to said panels at said stiles and reinforcing elements.

18. The garage door in accordance with claim 12 wherein said core is a closed cellular foamed synthetic resin.

19. The garage door in accordance with claim 18 wherein said skins are adhesively bonded to said core.

* * * * *